United States Patent [19]

Endo

[11] Patent Number: 4,985,815

[45] Date of Patent: Jan. 15, 1991

[54] LIGHT REFLECTOR

[75] Inventor: Nobuyuki Endo, Tokyo, Japan

[73] Assignee: Pioneer Electronic Corporation, Tokyo, Japan

[21] Appl. No.: 513,733

[22] Filed: Apr. 24, 1990

[30] Foreign Application Priority Data

Nov. 29, 1989 [JP] Japan ..... 1-307749

[51] Int. Cl.[5] ..... F21V 29/00

[52] U.S. Cl. ..... 362/294; 362/345; 362/373

[58] Field of Search ..... 362/294, 345, 373

[56] References Cited

U.S. PATENT DOCUMENTS 4,574,337 3/1986 Poppenheimer ..... 362/294
4,646,214 2/1987 Mendleski ..... 362/294
4,885,668 12/1989 Maglica et al. ..... 362/294

*Primary Examiner*—Carroll B. Dority

*Attorney, Agent, or Firm*—Sughrue, Mion, Zinn, Macpeak & Seas

[57] ABSTRACT

A reflector for use in combination with an intense light source, such as a light source for a projection liquid crystal display. The reflector comprises a reflecting member for reflecting light emitted by the light source, a cooling frame having a hollow receiving the reflecting member therein, externally provided with a plurality of heat radiating fins and having a shape substantially conforming to the external shape of the reflecting member, and heat conductive powder filling a space of a substantially uniform width formed between the reflecting member and the inner surface of the hollow of the cooling frame. The heat conductive powder keeps the reflecting member and the cooling frame in close thermal contact with each other so that heat applied to the reflecting member by the light source may be transferred efficiently to the cooling frame to suppress temperature rise in the reflecting member.

3 Claims, 1 Drawing Sheet

LIGHT REFLECTOR

BACKGROUND OF THE INVENTION

1. Field of the Invention

The present invention relates to a light reflector for reflecting light emitted by a light source and, more specifically, to a light reflector suitable for use in combination with a high-output light source, such as a liquid crystal projector.

2. Description of the Prior Art

FIG. 3 shows, by way of example, a conventional projection liquid crystal display employing such a high-output light source. Light rays emitted by a light source 10 and reflected by a reflector 20 are gathered in parallel light rays and directed toward the rear surfaces of liquid crystal cells 40 by a condenser lens 30. The light rays transmitted through the liquid crystal cells 40 form a visible image. The image formed on the liquid crystal cells 40 is then projected through a projection lens, not shown, onto a screen or the like in an enlarged image.

Since the image is projected onto the screen in an enlarged image, the liquid crystal cells must form the image in a high luminance, and hence a high-output light source must be used. Therefore, the reflector must be cooled by some means to suppress the rise of temperature in the reflector because the high-output light source gives intense heat to the reflector. The conventional cooling means for cooling the reflector employs a fan for forced air cooling, which generates large noise.

It is possible that a glass reflector cracks due to stress induced therein by local temperature rise because glass has a very low heat conductivity.

SUMMARY OF THE INVENTION

Accordingly, it is an object of the present invention to provide a reflector for reflecting light rays emitted by a light source, capable of automatically suppressing temperature rise without employing any means for forced cooling, such as a fan.

To achieve the object, the present invention provides a reflector for reflecting light rays emitted by a light source, comprising a reflecting member, and a heat radiating frame receiving the reflecting member therein and externally provided with heat radiating fins for radiating heat generated therein into the ambience.

The reflector contains a heat conductive powder in a space formed between the reflecting member and the cooling frame to enhance heat transfer from the reflecting member to the cooling frame.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENT

Figure 1:
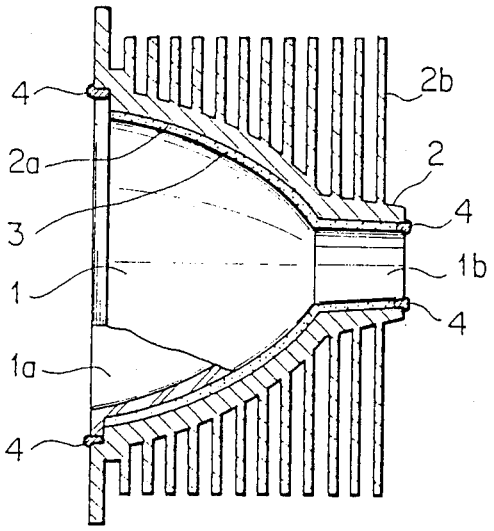
FIG. 1 is a sectional view of a reflector in a preferred embodiment according to the present invention.
Figure 2:
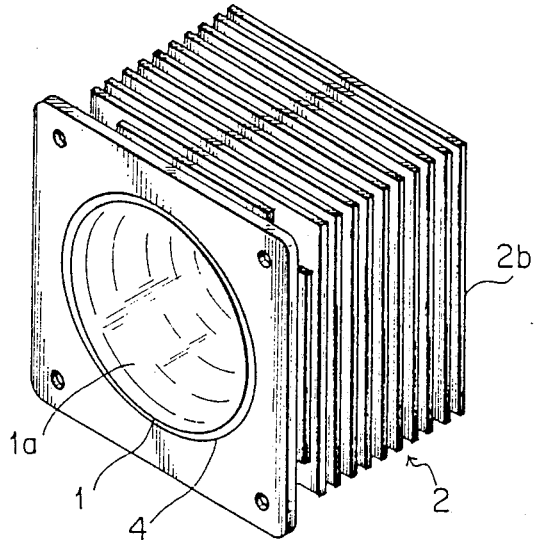
FIG. 2 is a perspective view of the reflector of FIG. 1.
Figure 3:
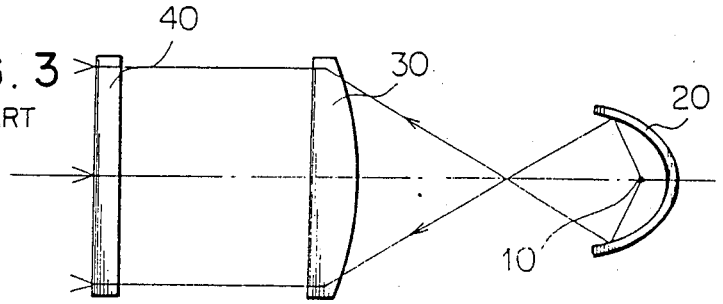
FIG. 3 PRIOR ART
FIG. 3 is a schematic view of a conventional projection liquid crystal display.

Referring to FIGS. 1 and 2, a reflecting member 1 is formed of glass generally in a shape resembling a bell and has a spheroidal reflecting surface 1*a* formed by coating its inner surface with a reflective film by evaporation or the like. A socket holding portion 1*b* for holding a socket for supporting a light source is formed with its axis aligned with that of the reflecting surface 1*a* in the bottom of the reflecting member 1.

A cooling frame 2 formed of an aluminum alloy by die casting has a hollow 2*a* having a shape conforming to the external shape of the reflecting member 1 and is provided externally with a plurality of heat radiating fins 2*b*.

Heat conductive copper powder 3 of a mesh on the order of #200 is filled and sealed in a space formed between the reflecting member 1 and the cooling frame 2. In sealing the heat conductive copper powder 3 in the space, the reflecting member 1 is fitted in the hollow 2*a* of the cooling frame 2, the gap between the front edge of the reflecting member and the front end of the cooling frame 2 is sealed with a heat-resistant adhesive 4, the copper powder 3 is poured into the space formed between the reflecting member 1 and the cooling frame 2 through the gap between the rear edge of the socket holding portion 1*b* of the reflecting member 1 and the rear end of the cooling frame 2 to fill up the space with the copper powder 3, and then the gap between the rear edge of the socket holding portion 1*b* and the rear end of the cooling frame 2 is sealed with the same heat-resistant adhesive 4.

The copper powder 3 filling up the space ensures the thermal connection of the reflecting member 1 and the cooling frame 2 and enables efficient heat transfer from the reflecting member 1 to the cooling frame 2 so that heat applied to the reflecting member 1 is transferred efficiently to the cooling frame 2 and is radiated from the cooling fins 2*b* to suppress temperature rise in the reflecting member 1. Since the reflecting member 1 is surrounded by the copper powder 3 having a high heat conductivity, the reflecting member 1 is heated uniformly, and hence there is no possibility of the reflecting member 1 cracking.

In transferring heat from a body A through a body B to a body C, the conductivity of the body B is represented by contact thermal resistance expressed by:

$$\theta = \rho \cdot t / S$$

where $\theta$ is contact thermal resistance (° C/W), $\rho$ is specific thermal resistance (cm·° C/W), t is the thickness of the body B (cm) and S is contact area ($cm^2$).

The efficiency of heat transfer from the reflecting member 1 to the cooling frame 2 will be examined hereunder with a case in which the space between the reflecting member 1 and the cooling frame 2 is filled with air and a case in which the space is filled with the copper powder 3.

Suppose that the width of the space is 0.2 cm, the area of the surface of the reflecting member 1 in contact with the copper powder 3 is 8 cm:, the specific thermal resistance of air is 31.5564 cm.° C/W, and the specific thermal resistance of the copper powder is 0.262 cm.° C/W. Then, the respective contact thermal resistances of the air filling the space and the copper powder filling the space are $7.89 \times 10^{-1}$ ° C/W and $6.55 \times 10^{-3}$ ° C/W, respectively. Therefore, the temperature gradient between the reflecting member 1 and the cooling frame 2 when heat is applied to the reflecting member 1 at 60 W is 47.30° C. when the space is filled with air and is 0.393° C. when the space is filled with the copper powder. Thus, the copper powder 3 reduces the temperature gradient between the reflecting member 1 and the cooling frame 2, which enables efficient heat transfer from the reflecting member 1 to the cooling frame 2.

The copper powder 3 may be substituted by any other suitable material having a high thermal conductivity, such as silicon powder or a heat-resistant adhesive containing copper powder.

Since the reflecting member 1 and the cooling frame 2 are kept in thermal contact by the heat conductive material (the copper powder 3) filling the space between the reflecting member 1 and the cooling frame 2, the width of the space between the reflecting member 1 and the cooling frame 2 may comparatively optionally be changed, and the dimensional accuracy of the external shape of the reflecting member 1 need not be very high. Accordingly, the manufacture of the reflecting member 1 is facilitated and the present invention is applicable also to a reflector employing a reflecting member having a complicated shape. Since the heat applied to the reflecting member is transferred efficiently through the copper powder to the cooling frame and is radiated efficiently from the heat radiating fins, the reflector need not be provided with any cooling fan.

The employment of an accurately finished reflecting member and an accurately finished cooling frame enhances heat transfer from the reflecting member to the cooling frame to suppress temperature rise in the reflecting member more effectively.

The present invention may be embodied in a reflector having a reflecting member and a cooling frame which are formed integrally of a metal in a single unit.

The shape of the reflecting surface of the reflecting member may be any suitable shape other than a spheroidal shape, such as a paraboloidal shape or a suitable concave shape Although the invention has been described in its preferred form with a certain degree of particularity, obviously many changes and variations are possible therein it is therefore to be understood that the present invention may be practiced otherwise than as specifically described herein without departing from the scope and spirit thereof.

What is claimed is:

1. A reflector for use in combination with a light source, comprising: a reflecting member having an inner surface for reflecting light emitted by the light source; a cooling frame having a hollow receiving the reflecting member therein and having a shape substantially conforming to the external shape of the reflecting member, and externally provided with a plurality of heat radiating fins; and heat conductive material filling a space formed between the reflecting member and the cooling frame.

2. A reflector according to claim 1, wherein the heat conductive material is powder of a heat conductive material.

3. A reflector according to claim 1, wherein the heat conductive material is a mixture of a heat-resistant adhesive and powder of a heat conductive material.

* * * * *